US006325532B1

(12) United States Patent
King et al.

(10) Patent No.: US 6,325,532 B1
(45) Date of Patent: Dec. 4, 2001

(54) METHOD FOR MIXING VISCOUS FLUIDS

(75) Inventors: Ronnald B. King, Spokane, WA (US); David Marshall King, Ridgecrest, CA (US)

(73) Assignee: Site-b Company, Spokane, WA (US)

( * ) Notice: Subject to any disclaimer, the term of this patent is extended or adjusted under 35 U.S.C. 154(b) by 0 days.

(21) Appl. No.: 09/667,113

(22) Filed: Sep. 18, 2000

Related U.S. Application Data

(6263) Continuation-in-part of application No. 09/556,594, filed on Apr. 21, 2000, now Pat. No. 6,193,405, which is a continuation of application No. 09/091,145, filed as application No. PCT/US96/19345 on Dec. 5, 1996, now Pat. No. 6,062,721, which is a continuation of application No. 08/567,271, filed on Dec. 5, 1995, now abandoned.

(51) Int. Cl.[7] ..... B01F 7/26

(52) U.S. Cl. ..... 366/129; 366/265; 366/317; 366/605

(58) Field of Search ..... 366/129, 130, 366/262, 263, 265, 270, 315–317, 342, 343, 348, 605; 416/178, 184, 187

(56) References Cited

U.S. PATENT DOCUMENTS

| | | |
|---|---|---|
| 59,493 | 11/1866 | Willcox . |
| 1,067,007 | 7/1913 | Douglas . |
| 1,084,210 | 1/1914 | Howard . |
| 1,765,386 | 6/1930 | Wait . |
| 1,908,002 | 5/1933 | Valentine . |
| 2,226,470 | 12/1940 | McGuffee . |
| 2,230,146 | 1/1941 | Myers . |
| 2,520,540 | 8/1950 | Green . |
| 2,724,547 | 11/1955 | Abbott et al. . |
| 2,803,398 | 8/1957 | Sprouse . |
| 2,879,044 | 3/1959 | Gunas . |
| 3,166,303 | 1/1965 | Chapman . |
| 3,319,940 | 5/1967 | Mentnech . |
| 3,362,689 | 1/1968 | Rothman et al. . |
| 3,423,075 | 1/1969 | Knudsen et al. . |
| 3,464,622 | 9/1969 | Dennis . |
| 3,521,973 | 7/1970 | Schouw . |
| 3,690,621 | 9/1972 | Tanaka . |
| 3,733,645 | 5/1973 | Seiler . |
| 3,846,043 | 11/1974 | Wolbrink et al. . |
| 3,972,512 | 8/1976 | Grise et al. . |
| 4,175,875 | 11/1979 | Van Horbek . |
| 4,472,063 | 9/1984 | Eickelmann . |
| 4,483,624 | 11/1984 | Bacon, Jr. et al. . |
| 4,538,922 | 9/1985 | Johnson . |
| 4,738,593 | 4/1988 | Reifschneider . |
| 4,893,941 | 1/1990 | Wayte . |
| 4,900,159 | 2/1990 | Jamison . |
| 4,948,262 | 8/1990 | Tome, Jr. . |
| 5,073,033 | 12/1991 | Klepeis . |
| 5,251,979 | 10/1993 | Larsen . |
| 5,314,310 | 5/1994 | Bachellier . |
| 5,417,493 | 5/1995 | Ericson . |
| 5,865,539 | 2/1999 | Rogers . |

(List continued on next page.)

FOREIGN PATENT DOCUMENTS

| | | |
|---|---|---|
| 2225800 | 7/1980 | (DE) . |
| 1064111 | 4/1967 | (GB) . |
| WO 97/20623 | 6/1997 | (WO) . |

*Primary Examiner*—Charles E. Cooley
(74) *Attorney, Agent, or Firm*—Weide & Associates

(57) ABSTRACT

The present invention is a method and apparatus for mixing viscous fluids. The mixing apparatus comprises a cage located on or along a shaft. The cage comprises a support with top and bottom sides. A number of vanes extend from one or both sides of the support. In one embodiment, the vanes are generally located near an outer edge of the support. The method comprises rotating the mixing apparatus in a container of fluid.

4 Claims, 4 Drawing Sheets

U.S. PATENT DOCUMENTS

| | | | |
|---|---|---|---|
| 5,984,518 | | 11/1999 | King et al. . |
| 5,988,979 | | 11/1999 | Wang . |
| 6,062,721 | | 5/2000 | King et al. . |
| 6,068,395 | | 5/2000 | Ondracek . |
| 6,193,405 | * | 2/2001 | King et al. . |
| 6,257,753 | * | 7/2001 | King et al. . |

* cited by examiner

METHOD FOR MIXING VISCOUS FLUIDS

PRIOR APPLICATION DATA

This application is a continuation-in-part of U.S. application Ser. No. 09/556,594 filed Apr. 21, 2000, now U.S. Pat. No. 6,193,405, which is a continuation of U.S. application Ser. No. 09/091,145 filed Apr. 16, 1999, now U.S. Pat. No. 6,062,721, which is a 371 of International Application No. PCT/US96/19345, filed Dec. 5, 1996, which is a continuation of U.S. application Ser. No. 08/567,271, filed Dec. 5, 1995, now abandoned.

FIELD OF THE INVENTION

The present invention relates to a method and apparatus for mixing fluids and similar materials.

BACKGROUND OF THE INVENTION

The mixing of viscous fluids has historically been a difficult task. Present methods of mixing such fluids often result in inadequate mixing and are time-consuming and energy consumptive.

One of the more common viscous fluids which must be mixed is paint. Homeowners and painters are all too familiar with the task of mixing paint.

Probably the most common method of mixing fluid such as paint involves the user opening the container, inserting a stir stick or rod and rotating or moving the stick about the container. This method is tiring, requiring tremendous effort to move the stir stick through the viscous fluid. Because of this, individuals often give up and stop mixing long before the paint is adequately mixed. Further, even if the individual moves the stir stick for a long period of time, there is no guarantee that the paint is thoroughly mixed, rather than simply moved about the container.

Many mechanisms have been proposed for mixing these fluids and reducing the manual labor associated with the same. These mechanisms have all suffered from at least one of several drawbacks: users have difficulty in using the device because of its complexity or size, the device inadequately mixes the fluid, the device mixes too slowly, the device does not break up or "disperse" clumped semi-solids in the fluid, and/or the users have a difficult time cleaning up the device after using it. As one example, these prior methods of mixing are generally inadequate for the purpose of mixing hard to mix materials such as additives and tints which must be thoroughly distributed in homogenous fashion to produce the desired end product. Other problems associated with these mixers are that they often introduce air into the fluid (which, in the case of paint and other coating materials is detrimental, for example, when the material is to be sprayed with a sprayer), they do not trap globules/particles which do not go into solution, and many of the mixing devices may damage the container in which the fluid is being mixed, causing the fluid to leak from the container or parts of the damaged container to enter the material being mixed.

One example of such a mechanized mixing device is essentially a "screw" or auger type device. An example of such a device is illustrated in U.S. Pat. No. 4,538,922 to Johnson. This device is not particularly effective in mixing such fluids, as it imparts little velocity to the fluid. Further, the device does not disperse clumped material in the fluid, but simply pushes it around the container.

Another method for mixing paint comprises shaking the paint in a closed container. This can be done by hand, or by expensive motor-driven shakers. In either instance, the mixing is time consuming and often not complete. Because the shaking occurs with the container closed, little air space is available within the container for the fluid therein to move about. Therefore, the shaking often tends to move the fluid very little within the container, with the result being ineffective mixing.

Several devices have been developed for mixing paint which comprise devices for connection to drills. For example, U.S. Pat. No. 4,893,941 to Wayte discloses a mixing device which comprises a circular disc having vanes connected thereto. The apparatus is rotated by connecting a drill to a shaft which is connected to the disc. This device suffers from drawbacks. First, the limited number of vanes does not provide for thorough mixing. Second, because the bottom disc is contiguous, no fluid is drawn through the device from the bottom. It is often critical that fluid from the bottom of the container be drawn upwardly when mixing viscous fluids, since this is where the heaviest of the fluids separate prior to mixing.

U.S. Pat. No. 3,733,645 to Seiler discloses a paint mixing and roller mounting apparatus comprising a star-shaped attachment. This apparatus is not effective in mixing paint, as it does not draw the fluid from the top and bottom of the container. Instead, the paddle-like construction of the device simply causes the fluid to be circulated around the device.

U.S. Pat. No. 1,765,386 to Wait discloses yet another device for mixing liquids. This device is wholly unacceptable, as it must be used in conjunction with a diverter plate located in the container to achieve adequate mixing. Use of the diverter plate would either require its installation into a paint container before being filled, which would increase the cost of paint to the consumer, or require that the consumer somehow install the device into a full paint container.

An inexpensive method for mixing viscous fluids in a quick and effective manner is needed.

SUMMARY OF THE INVENTION

The present invention is a method and apparatus for mixing viscous fluids and similar materials.

One embodiment of the invention comprises a mixing device including a mixing cage connected to a shaft. The shaft is elongate, having a first end connected to a support and a second free end for connection to the rotary drive means. In one embodiment, the support is generally circular, and has a top side, bottom side, and outer edge. In one embodiment vanes in the form of thin, curved slats, are spacedly positioned about the outer edge of each side of the support. In one or more embodiments, the vanes extend outwardly from each side of the support parallel to the shaft. In one or more embodiments, a first end of each vane is connected to the support near the outer edge thereof.

In various embodiments, the vanes are connected at their second ends by a hoop, the vanes have a length which is between about 0.1–2 times the diameter of the support, the number of vanes located about each side of the support preferably number between 4 and 12 per inch diameter of the support, and/or each vane extends inwardly from the periphery of the support no more than about 0.1–0.35 of the distance from the center of the support to the periphery thereof at that location. In one or more embodiments, the number of vanes located about each side of the support is selected so that the vanes trap globules. In one embodiment, the vanes are spaced no more than about 0.25 inches apart.

In one embodiment of the invention, the mixing device is specially configured for use in mixing very viscous fluids and even particulate solid material. In a configuration of this embodiment, each vane is generally short, having a length of no more than about 0.3 times the diameter of the plate or support, and pairs of vanes have a slightly larger minimum spacing between them, on the order of about 0.25–0.35 inches. In this embodiment, it is desirable that the free ends of the vanes not be connected, whereby the edges thereof serve to shear material through which they pass.

One or more embodiments of the invention comprise a method of mixing comprising locating a mixing device in a container of fluid and rotating the device in the fluid. In one embodiment, the method includes the steps of a user positioning the mixing cage of the device in a container of fluid, connecting a free end of a shaft of the device to the rotary drive means, such as a drill, and rotating the mixing cage within the fluid.

Further objections, features, and advantages of the present invention over the prior art will become apparent from the detailed description of the drawings which follows, when considered with the attached figures.

DETAILED DESCRIPTION OF THE INVENTION

The invention is a method and apparatus for mixing viscous fluids. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Generally, the invention comprises a mixing device and a method of mixing fluid in a container containing a fluid to be mixed with the device. As used herein, the term "fluid" generally means liquids, especially those of a viscous nature whether containing dissolved or undissolved solids, slurries, gels and those groupings of solid or semi-solid materials which behave in some respects as a fluid, such as granular and particulate materials (e.g. flour, sugar, sand etc.).

Figure 1:
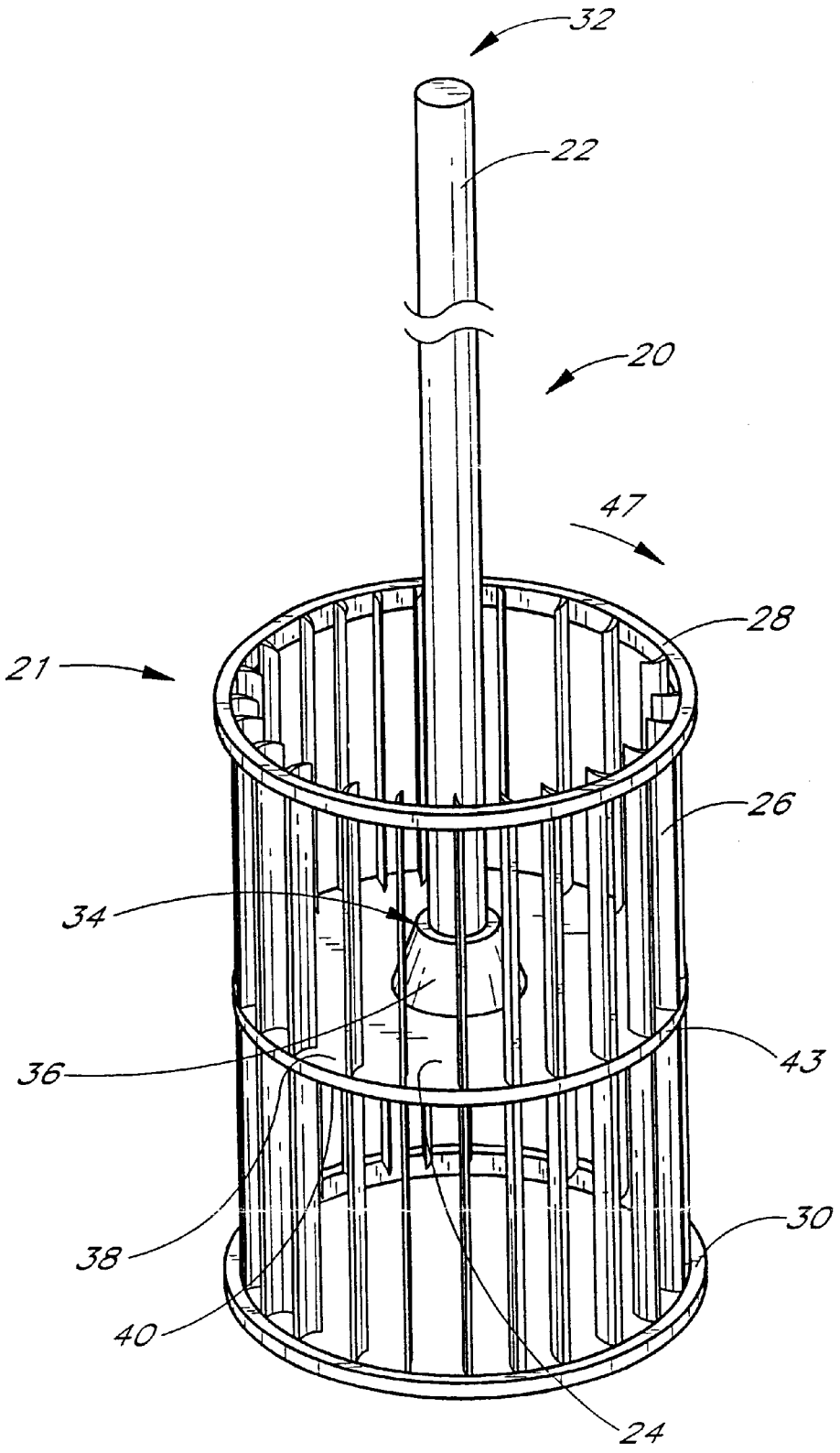
FIG. 1 is a perspective view of a mixing device in accordance with a first embodiment of the invention for use in the method of the present invention.
Figure 5:
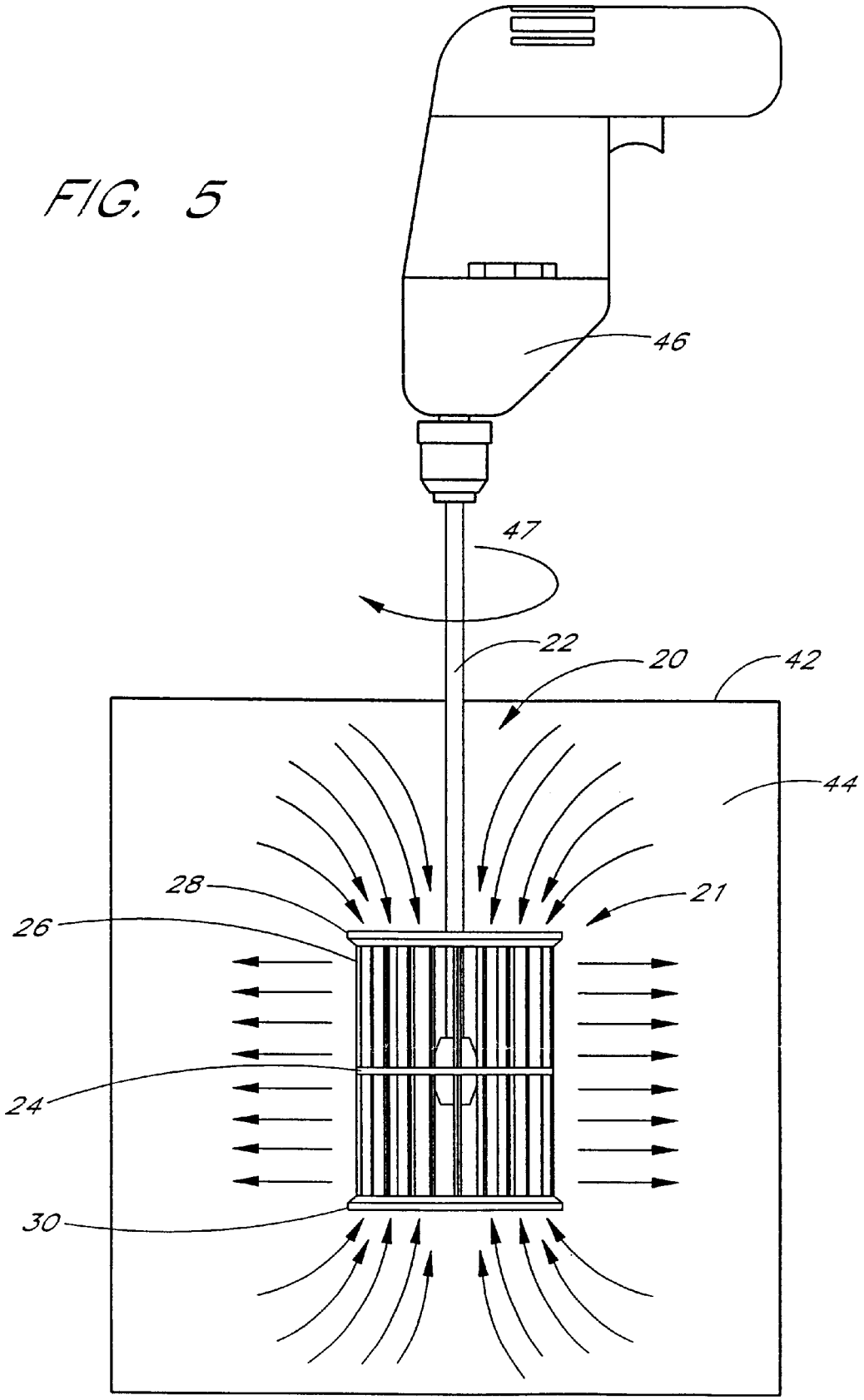
FIG. 5 illustrates use of the mixing device illustrated in FIG. 1 to mix a fluid in a container.

One embodiment of a mixing device 20 in accordance with the present invention is illustrated in FIG. 1. This embodiment mixing device 20 generally comprises a cage-like structure having open ends. As illustrated in FIG. 5, the device 20 includes a shaft 22 for rotation by rotary drive means such as a drill 46, the shaft connected to a support 24. In one embodiment, the support 24 comprises a central connecting plate. Vanes 26 extend outwardly from each side of the support 24 parallel to the shaft 22. In one embodiment, the vanes 26 are connected at their ends opposite the support by a hoop 28,30.

In use, a user positions the mixing device in a container 42 of fluid 44. The user connects the shaft 22 of the device 20 to a drill 46 and rotates it within the fluid. As illustrated in FIG. 5, the mixing device 20 mixes the fluid by drawing it from the top and bottom of the container 42 and forcing it radially outward through the vanes 26.

The mixing device 20 for use in the present invention will now be described with more particularity with reference to FIGS. 1–5. In general, and as illustrated in FIG. 1, the device 20 includes mixing cage 21 connected to a shaft 22, the mixing cage 21 comprising a support 24, vanes 26, and two hoops 28, 30.

The shaft 22 is an elongate rigid member having a first end 32 and second end 34. The exact length and diameter of the shaft 22 depends on the depth of the fluid in the container to be mixed. When the device 20 is for use in mixing paint in a standard one-gallon paint can, the shaft 22 can be about 8–9 inches long and about 0.25 inches in diameter.

The first end 32 of the shaft 22 is adapted for connection to a rotary drive means. Preferably, the rotary drive means comprises a drill, as illustrated in FIG. 5. Preferably, the shaft diameter is chosen so that engagement with the rotary drive means is facilitated.

The second end 34 of the shaft 22 is connected to the support 24. Preferably, the second end 34 of the shaft 22 engages an adapter 36 connected to the support 24. In one embodiment, the shaft end 34 engages the support 24 at the center point of the support 24. As described below, the shaft may engage, and thus rotate, the cage at a point offset from the center of the support and/or central axis of the cage. In addition, the cage need not be connected to the second end 34 of the shaft 22. For example, the cage may be positioned along the shaft 22 between its ends, with the second end of the shaft 22 actually positioned distal of the entirely of the cage. In this regard, it is noted that the primary purpose of the shaft 22 is to impart motion to the cage.

The support 24 may have a variety of configurations, including shapes and sizes. In one embodiment, the support 24 comprises a central plate in the form of a flat, disc-shaped member having a top surface 38, bottom surface 40 and outer edge 43. In one embodiment, the plate is generally solid. In one or more embodiments, the plate has holes or openings therein. In one embodiment, the shaft 22 engages the support 24 at the top surface 38 thereof.

The support 24 may be constructed of a wide variety of materials. In one or more embodiments, the support 24 may be constructed along with the other portions of the device 20 of a plastic or metal in a molding process. When used to batch mix a one gallon quantity of highly viscous (i.e. resists flow) liquids such as paint, the support 24 may be generally circular and have a diameter of about 1–4, and most preferably about 2.5 inches. It will be appreciated that the support 24 may have a variety of shapes other than circular, such as oval, irregular and the like. In one or more embodiments, the support 24 may comprise struts, rods, hoops or other elements for use in supporting one or more of the vanes 26.

In one or more embodiments, a number of vanes 26 extend from the top and bottom surface 38, 40 respectively, of the support 24 near the outer edge 43 or periphery thereof. Each vane 26 has a concave surface 27 and a convex surface 29 (see FIGS. 2 and 4). All of the vanes 26 are oriented on the support 24 in the same direction. The vanes 26 are oriented on the support 24 in a manner such that they face in the direction of rotation indicated by arrow 47 in FIGS. 1, 2, 4 and 5, when rotated by the rotational drive means 46.

The vanes 26 are preferably constructed of durable and fairly rigid material. It has been found preferable that the ratio of the length of the vanes 26 to the diameter of the support be between about 0.1 and 2, and most preferably between 0.2 and 0.7. Moreover, it has been found preferable that the number of vanes 26 be dependent on the ratio of the diameter of the support 24 on the order of about 4–12, and most preferably about 9 vanes per inch diameter of the support 24. The width of each vane 26, is preferably no more than 0.1 to 0.35 times the radius of the support 24, and more preferably about 0.1–0.3, and most preferably about 0.25 times the radius of the support 24. The thickness of each vane 26 depends on the material from which it is made. Regardless of its width, each vane 26 is preferably positioned at the outer edge 43 of the support 24 such that the vane 26 extends inwardly therefrom no more than about 0.1–0.35, more preferably less than about 0.3, and most preferably less than about 0.25, of the distance from the center of the support 24 to the periphery thereof at that vane 26 location (i.e. less than about 0.35 the radius when the support 24 is circular).

When the device 20 is configured for use in mixing paint in a one-gallon container and the support 24 diameter is about 2.5 inches, the vanes 26 are preferably about 1 inch long from their ends at the connection to the support 24 to their ends connected at the hoops 28, 30. Each vane 26 is preferably about 0.2–1, and most preferably about 0.3 inches wide.

Figure 2:
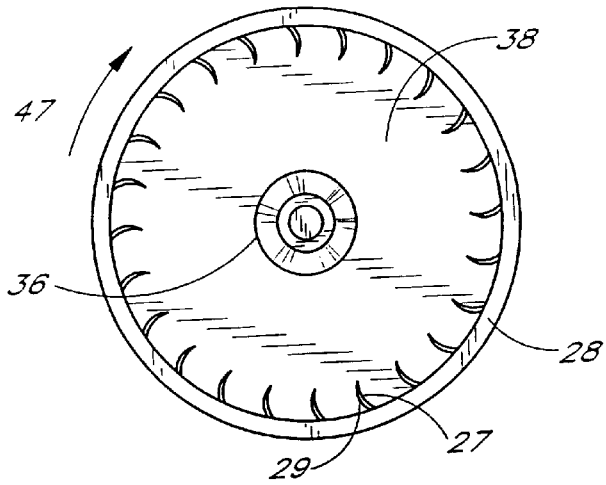
FIG. 2 is a top view of the mixing device illustrated in FIG. 1.
Figure 4:
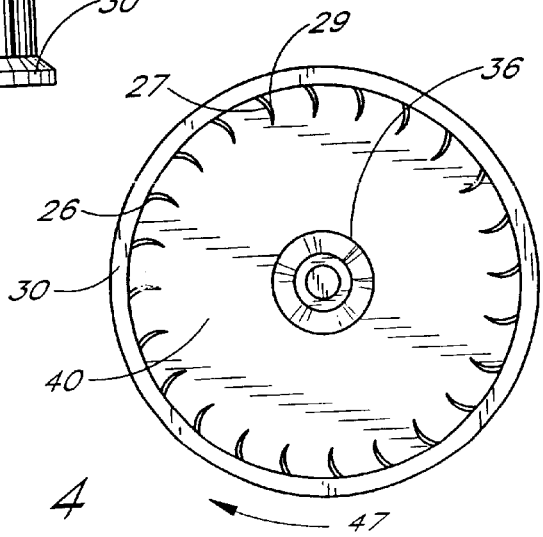
FIG. 4 is a bottom view of the mixing device illustrated FIG. 1.

In order to disperse partially solidified particulate in the fluid, the vanes 26 are fairly closely spaced about the outer edge 43 of the support 24. The vanes 26 are preferably spaced about 0.1–1 inch, and most preferably about 0.25 inches apart. When the vanes 27 are spaced far apart (e.g. about 1 inch) the vane width and/or height is preferably increased within the above-stated range or ratios. Thus, in the case where the support 24 has a diameter of about 2.5 inches, there are preferably about twenty-four vanes 26, as illustrated in FIGS. 1, 2 and 4.

Figure 3:
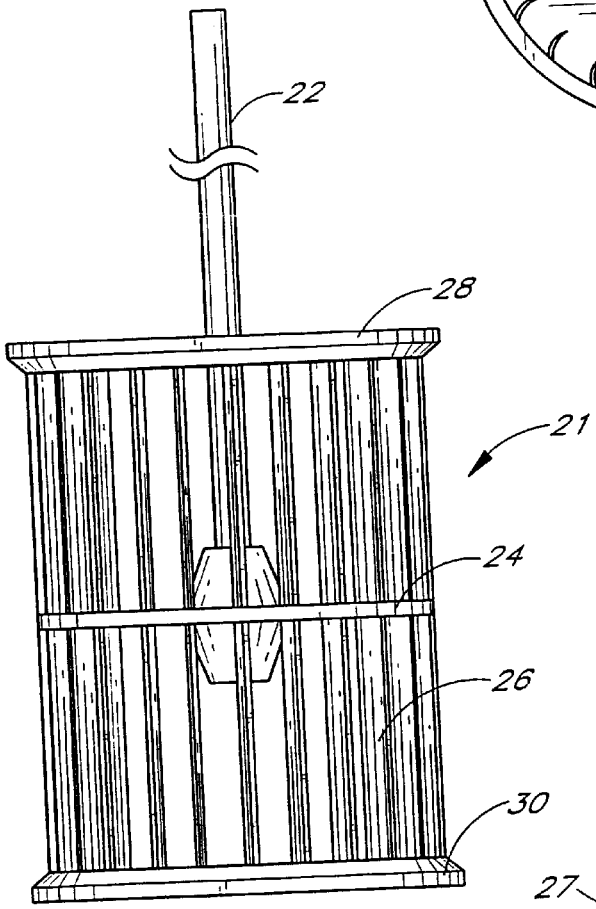
FIG. 3 is a side view of the mixing device illustrated in FIG. 1.

In one or more embodiments, in order to prevent relative movement between the free ends of the vane 26, the free end of each vane is connected to a support hoop 28,30. Each hoop 28,30 comprises a relatively rigid circular member. A first portion of each hoop 28,30 extends over the end of each of the vanes, and a second portion of each hoop 28,30 extends downwardly along the outer surface of each vane, as illustrated in FIGS. 2–4. In other embodiments, the hoops 28,30 may be configured and connected in other manners. Each vane 26 is securely connected to its corresponding hoop 28,30.

Use of the device 20 described above in the method of the resent invention will now be described with reference to FIG. 5.

A user obtains a container 42 containing fluid 44 to be mixed. This container 42 may comprise a paint can or any other container. The fluid 44 to be mixed may comprise nearly any type of fluid, but the method of the present invention is particularly useful in mixing viscous fluids.

The user attaches the device 20 of the present invention to rotary drive means. As illustrated in FIG. 5, the preferred means comprises a drill 46. The means may comprise apparatus other than a drill, however, such as hand-driven, pulley or gas motor driven means. These drive means preferably turn the shaft 22 of the device at speed dependent upon the viscosity of the fluid. For example, for low viscosity fluids, the rotational speed may be often as low as about 500 rpm, while for high viscosity fluids the rotational speed may often be as high as 1,500 rpm or more.

The user attaches the first end 32 of the shaft 22 to the drill 46, such as by locating the end 32 of the shaft in the chuck of the drill. Once connected, the user lowers the mixing cage 21 into the fluid 44 in the container 42. The user locates the mixing cage 21 below the top surface of the fluid.

Once inserted into the fluid 44, the drill 46 is turned on, thus effectuating rotational movement of the mixing cage 21. While the cage 21 is turning, the user may raise and lower it with respect to the top surface of the fluid and the bottom of the container, as well as move it from the center to about the outer edges of the container, so as to accelerate the mixing of the fluid therein.

Advantageously, and as illustrated in FIG. 5, the device 20 of the present invention efficiently moves and mixes all of the fluid 44 in the container 42. In particular, because of the location of vanes extending from and separated by the support 24, the mixing cage 21 has the effect of drawing fluid downwardly from above the location of the cage 21, and upwardly from below the cage, and then discharging the fluid radially outwardly (as illustrated by the arrows in FIG. 5). This mixing effect is accomplished without the need for a diverter plate in the bottom of the container.

Most importantly, partially solid particulate in the fluid is effectively strained or dispersed by the vanes 26 of the cage 21. The close spacing of the vanes 26 traps unacceptably large undeformable globules of fluid or other solid or partially solid material in the cage, for removal from the cage after mixing. Other globules of partially solidified fluid material are sheared apart and dispersed when they hit the vanes, reducing their size and integrating them with the remaining fluid.

Advantageously, optimum mixing is achieved with the present device 20 as a result of the positioning of substantially long inner and outer vane edges away from the center of the device and thus at the periphery of the support 24. This allows the fluid moving though the device 20 to impact upon the inner edge of the vane 26 at a high radial velocity and therefore with great force. Further, the outer edge of the vane has a high velocity in relation to the fluid in the container positioned outside of the device 20, thereby impacting upon that fluid with great force.

The ratio of the length of each vane to its width, and the placement of the vanes at the periphery of the support, creates maximum fluid flow through the cage 21. This is important, for it reduces the total time necessary to thoroughly mix the fluid in a particular session.

In an embodiment where the device 20 includes hoops 28,30, the hoops, 28,30 protect the container from damage by the spinning vanes 26. This allows the user to be less careful in positioning the cage 21 in the container 42, as even if the cage 21 encounters the sides or bottom of the container, the cage is unlikely to damage the container.

Another advantage of the mixing device 20 of the present invention is that it mixes the fluid without introducing air into the fluid, as is a common problem associated with other mixers utilized for the same purpose. As can be understood, the introduction of air into a fluid such as paint is extremely detrimental. For example, air within paint will prevent proper operation of many types of paint sprayers and makes uniform coverage when painting difficult. The presence of air is also detrimental, for example, where a polyurethane coating is being applied, as air bubbles become trapped in the coating and ruin its appearance.

After the fluid has been adequately mixed, cleaning of the device 20 is fast and easy. A user prepares a container filled with a cleaning agent. For example, in the case of latex paints, water is an effective cleaning agent. The user lowers the cage 21 into the cleaning agent, and turns on the drill 46. The rapid movement of the cleaning agent through the cage 21 causes any remaining original fluid (such as paint) or trapped globules thereon to be cleansed from the device 20.

Once the device 20 is clean, which normally only takes seconds, the device can be left to air dry.

The dimensions of the device 20 described above are preferred when the device is used to mix fluid in a container designed to hold approximately 1 gallon of fluid. When the device 20 is used to mix smaller or larger quantities of fluid of similar viscosity, the device 20 is preferably dimensionally smaller or larger.

While the vanes 26 of the device 20 are preferably curved, it is possible to use vanes which are flat. The vanes 26 are preferably curved for at least one reason, in that such allows the vanes 26 to have an increased surface area without extending inwardly from the periphery towards the center of the support 24 beyond the preferred ratio set forth above. Also, it is noted that while the vanes 26 extending from the top and bottom of the support 24 are preferably oriented in the same direction, they may be oriented in opposite directions (i.e. the convex surfaces of the top and bottom sets of vanes 26 may face opposite directions).

In an alternate version of the invention, vanes only extend from one side of the support. The vanes may extend from either the top or the bottom side. Such an arrangement is useful when mixing in shallow containers, while retaining the advantages of high fluid flow mixing rates and the straining capability. In this arrangement, or that where the vanes 26 do not extend from each side the same distance, it will be appreciated that the support 24 is not "central," but still provides the supporting functions described.

As described above, it is possible for the support 24 to have an irregular shape, or at least one which is not circular. In such event, in one or more locations the outer edge of the support 24 may be positioned outwardly of the outer edge of the vanes 26. Even where the support 24 is circular, the outer edges of the vanes 26 need not be positioned at the outer edge of the support 24, but instead be set back inwardly therefrom. In the event where the outer edge of the vanes 26 is not coincident with the outer edge of the support 24, it is desirable that the above-referenced distances by which the vanes extend inwardly comprise a ratio of the distance of the inner edge of the vane 26 to the center of the support 24 to the distance of the outer edge of the vane to the center of the support. Likewise, the vanes 26 need not be arranged in a circle on the support 24.

A mixing device 120 and method of use in accordance with a second embodiment of the present invention will be described with reference to FIGS. 6–8. While this embodiment mixing device 120 is useful in mixing a wide variety of materials, including the generally viscous materials referred to above, the device 120 is particularly suited to applications in which the device is used to mix extremely viscous materials and particulate solid/semi-solid materials. Such materials include, but are not limited to, food batter, joint compounds and wall plasters, and pharmaceutical materials.

Figure 6:
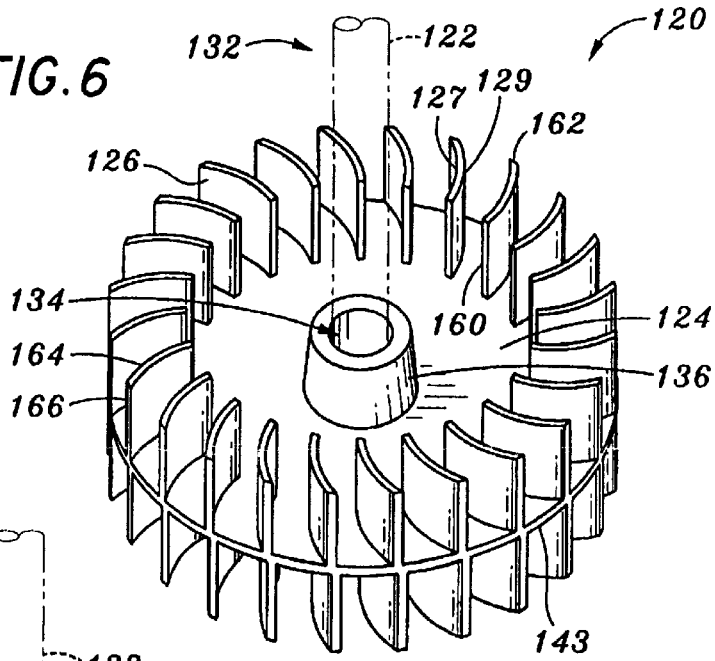
FIG. 6 is a perspective view of mixing device in accordance with another embodiment of the present invention

Referring first to FIG. 6, the mixing device 120 is generally similar to the device 20 illustrated in FIGS. 1–5, except primarily for the configuration of vanes thereof. Thus, the mixing device 120 comprises a cage-like structure having generally open ends. The device 120 includes a shaft 122 for rotation by a rotary drive means such as a drill (in similar fashion to that illustrated in FIG. 5). The shaft 122 connects to a connecting plate or support 124.

As in the prior embodiment, the shaft 122 may be constructed from a variety of materials and be of a variety of sizes and shapes. The shaft 122 has a first end 132 for connection to a rotary drive device and a second end 134 connected to the support 124. As illustrated, the second end 134 of the shaft 122 engages a hub 136 or similar adaptor member associated with the support 124. The second end 134 of the shaft 122 securely engages the support 124 and aids in preventing relative rotation of the shaft 122 with respect to the support 124.

In one or more embodiments, the support 124 has an outer edge 143 defining a generally circular perimeter. Preferably, the shaft 122 is connected to the support 124 at a center thereof, whereby the mixing cage rotates generally symmetrically about an axis through the shaft 122. In one or more embodiments, the support 124 has a diameter of as little as 5/16 inches or less, but may have a very large diameter. For many common applications, the diameter of the support 24 is about 3–4 inches. In general, the exact diameter of the device 20 may vary dependent upon the particular use of the device 20. For example, if the device 20 is to be used in mixing fluid in a container having a very small opening, the diameter of the device 20 must be small. On the other hand, for mixing materials in large industrial vats or the like, the diameter may be as large as 12 inches or even much larger.

As with the prior embodiment, the plate or support 124 need not be solid or circular, but may be of other shapes, including irregular. Where the support 124 is not circular, the size of the support may be made with reference to a maximum radial dimension from a center. In addition, the support 124 need not be rotated symmetrically. For example, in one or more embodiments, the shaft 122 may be offset from a center of the support 124.

In one embodiment, a number of vanes 126 extend from one or both of a top side 138 and bottom side 140 of the support 124. As illustrated, vanes 126 extend from both the top and bottom side 138,140 of the support 124. Each vane 126 has an inner edge 160 and an outer edge 162. Preferably, the outer edge 162 of each vane 126 is located near the outer periphery or edge of the support 124 and extends generally along a line perpendicular to the support 124.

Figure 8:
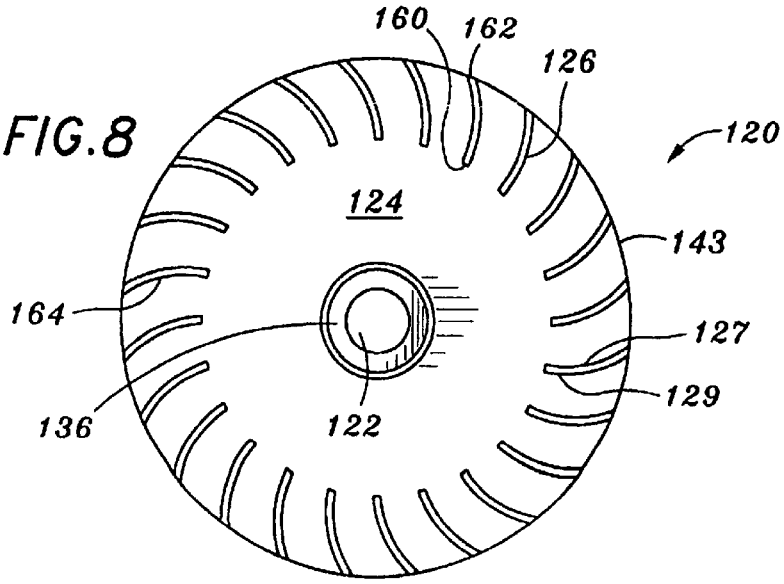
FIG. 8 is a top view of the mixing device illustrated in FIG. 6.

Referring to FIGS. 6 and 8, in one or more embodiments, each vane 126 is curved between its inner edge 160 and outer edge 162. The curved shape of each vane 126 causes it to have a concave surface 127 and a convex surface 129. Preferably, all of the vanes 126 on each side of the support 124 are oriented in the same direction. When vanes 126 are positioned on both sides of the support 124, the vanes 126 on opposing sides may be oriented in different directions.

Referring to FIGS. 6 and 8, each vane 126 has a first, top or distal end 164 and a second, bottom or proximal end 166. Preferably, each bottom or proximal end 166 is connected to the support 124. The top or distal end 164 is positioned remote from the support 124.

In one or more embodiments, each vane 126 has a length dependent upon the diameter (or other dimension from the center or axis of rotation) of the support 124. A length of each vane 126 (in inches) to the diameter of the support (in inches) generally falls within the ratio of about 0.05–3. In a preferred embodiment, this ratio is about 0.1–0.3, and is most preferably about 0.20. As described in detail below, it is desirable for the vanes 126 to be fairly short and wide to facilitate material movement through the device 120.

Because each vane 126 is generally short, the vanes 126 are sufficiently rigid to maintain their desired spacing and serve as a cutting and shearing members, without the need for connecting members. In fact, in contrast to the previous embodiment, in this embodiment it is preferred that the top ends 164 of the vanes 126 not be connected, as with a hoop or other connecting member. When mixing very viscous materials such as joint compound, hoops or other connecting members may impede the flow of the material through the device 120. More importantly, however, the top edge 164 and outer edge 162 of each vane 126 are useful in effecting mixing by impacting and cutting or shearing the material. A hoop or other member affects the ability of the vane 126 to shear and cut material, potentially reducing the efficiency of the device 120 in mixing material.

In some instances, it may still be desirable to provide such a hoop. For example, if the device 120 were to be used in mixing material in a delicate container, such hoops or other connecting members have the advantage that they reduce damage to a container (in the event the spinning vanes hit the side of the container during mixing).

Each vane 126 preferably extends inwardly from the outer periphery 143 of the support 124. In a preferred embodiment, each vane 126 extends inwardly towards the center of the support 124 by a relatively constant distance between its bottom end 166 and top end 164. In one or more embodiments, the vanes 126 extend inwardly about 0.1–0.7, more preferably no more than about 0.4, and most preferably no more than about 0.35 of the distance between the outer edge of the support and the center of the support 124. As described above, in the instance where the outer edge of the vane 126 is not located at the outer edge of the support 124, then these ratios preferably comprises the ratio of the distance the vanes 126 extend inwardly as compared to the distance from the center of the support to the outer edge of the vane 126.

In one or more embodiments, one or more of the vanes 126 may be configured so that only a portion of the inner edge 160 of each vane 126 falls within these ranges. In a preferred embodiment, all or substantially all of the vane 126 is within the range. As an example, the vanes 126 may have a sloping inner edge 160. At one or more points along this sloping inner edge 160, the vane 126 may be no more than the desired 0.7 of the distance between the center of the support 124 and the outer edge of the vane 126/support 124. At other points along this sloping inner edge 160, the inner edge may extend farther in towards the center of the support 124 than the desired ratio.

As stated above, the vanes 126 are wider, which when considering the shorter nature of the vanes, still permits the vanes to have a high surface area for maximizing fluid flow. An advantage of having the vanes 126 extend inwardly a greater distance is also that the length of the top edge 164 is increased, and thus also is the ability of the vanes 126 to shear material upon contact with the material. Another advantage of the shorter vane configuration is that the device 120 can be used to mix materials in shallow containers or where the depth of the material is shallow.

It has been found preferable for the number of vanes 126 to be dependent upon a spacing there between. As disclosed below, and in similar fashion to the mixing device 20 described above, it is desirable to maintain the vanes fairly closely spaced so that they are effective in trapping globules and other material which will not go into solution. In one or more embodiments, the maximum spacing between the vanes 126 is about 0.1–2, more preferably less than about 0.45 inches, and most preferably less than about 0.3–0.35 inches. The selected spacing may be dependent upon the material being mixed, including the size of undispersable material in the material. In the embodiment where the vanes 126 are positioned on a circular support 124 in a configuration as illustrated, the maximum distance between the vanes 126 occurs at the outer edge 162 thereof and the minimum distance occurs between the inner edges 160 of the vanes 126. In one embodiment, the vane 126 spacing at their inner edges 160 is about 0.26 inches, while the spacing at their outer edges 162 is about 0.35 inches. It will be appreciated that the minimum and maximum spacing between vanes 126 depends upon the number of vanes 126 in relation to the diameter of the support 124, and the distance by which the vanes 126 extend inwardly. If, for example, the diameter of the support 124 is large, then the vanes 126 may be spaced close together at their inner edges 160 but have a very large spacing at their outer edges 162.

In this arrangement, the spacing between the inner edges 160 of the vanes 126 facilitates trapping of globules of material which will not break down. Further, because of the closeness of the vanes 126, the material passing through the device 120 hits the vanes 126 and is sheared apart. Little of the material is permitted to pass through the device without impacting the vanes 126. On the other hand, because the spacing between the vanes 126 increases moving radially outwardly, once the material is sheared, it is permitted to move quickly to the outer edge of the device 120 for discharge. The larger spacing between the vanes 126 moving in direction radially outward serves to facilitate fluid flow and prevent unnecessary clogging, while the close spacing at the inner edges 160 serves to trap large globules and other material including that which does not enter solution. This facilitates maximum flow rate through the device 120, resulting in a high rate of mixing. Thus, a relatively close spacing of the vanes 126 in one or more areas is adapted to trap globules and shear material, and a greater spacing of the vanes 126 in other areas is adapted to provide for efficient flow of the material through the device 120 for high speed mixing.

It will be appreciated that the total number of vanes 126 may vary dependent upon their thickness, even though the spacing there between remains the same. Preferably, the number of vanes 126 totals about 2–16, more preferably about 4–12, and most preferably about 7 vanes per inch diameter of the support 124. In a preferred embodiment, the number of vanes 126 is selected within this range to still maintain the above-described spacing therebetween.

It will be appreciated that, all other parameters (i.e. vane length to support diameter, vane spacing and the like) remaining the same, a change of any of the above-referenced parameters may have an effect upon mixing performance. In some instances, one parameter may be adjusted in its preferred range and another parameter may be also adjusted in its preferred range to change specific optimized sub-functions of the device.

For example, the length of the vanes 126 in relation to the diameter of the support 124 may be adjusted dependent upon a wide variety of factors. In particular, if the length of each vane 126 is increased within the above-stated ranges, especially when considering the viscosity of the material being mixed and the radius of the inlet(s) being restricted to minimal size, the flow through the device may be somewhat inhibited. In such an event, the length of the vanes may be found to be an inhibiting factor on mixing performance, if other compensating factors do not exist. As an example, to offset such an effect, the distance by which the vanes 126 extend inwardly may be reduced so that a larger internal flow opening is defined, permitting increased fluid flow. Of course, such an "offset" in the vane 126 configuration should be within the above-stated ranges, or else other performance limiting effects may be realized. For example, if the vanes 126 are extended inwardly too far, the shearing effect upon the material will be reduced.

It will also be appreciated that the number of vanes 126 and their length may vary dependent to some degree on the particular application and the speed at which the mixing device 120 is to be operated. As detailed above, it may be preferable for the vanes 126 to be short in relation to the diameter of the support 124 and be positioned closer to the center of the support 124 when the material to be mixed is extremely viscous. Also, the vanes 126 may be short when the speed of rotation is very high, as the higher rotational speed aids in the mixing/shearing action without the need for such long vanes.

A change in the distance by which the vanes 126 extend inwardly may also affect mixing performance. If the distance by which the vanes extend inwardly is substantially reduced, the total surface area of the vanes 126 decreases, and generally also will the rate of mixing. As an example of a way to offset such an effect, the vanes 126 may be made taller to increase their surface area. As stated above, however, the total length of the vanes 126 should stay within the defined ranges or else detrimental effects such as vane bending and inhibited flow rates may again arise.

It will now be appreciated that the overall size of the support 124 is interrelated with the spacing of the vanes 126 and the distance by which the vanes extend inwardly. For example, if the support 124 is very small in diameter, then the number of vanes 126 which may be positioned on the support 124 and still maintain the desired spacing is substantially reduced. As the number of vanes 126 are reduced, so may be the ability of the device 120 to efficiently mix, especially when considering the type of material and other factors. One problem is that as the total number of vanes 126 is reduced, the edge surface area for the vanes 126 is reduced, and thus the cutting and shearing effect may be reduced. Also, if the support 124 is very small, the vanes 126 will be very narrow if they are not to extend towards the center of the support 124 by an undesirable distance. In such event, the surface area of the vanes 126 and their edge lengths may be reduced to a point at which mixing efficiency decreases.

In the description above, reference is made to particular configurations of the vanes 26,126. It will be appreciated that the vanes 126 may be configured differently than illustrated. For example, not every single vane 126 needs to extend inwardly within the defined range. Instead, some, such as every other vane 126, may extend inwardly a greater distance towards the center of the support 124 than the above-stated preferred distance. One or more of the vanes 126 may be taller or shorter than the others and fall within or outside of the preferred ranges described above. The vanes 26,126 may also have other than generally straight inner and outer edges. For example, the vanes 26,126 may have slanted or curved inner and/or outer edges, such as being wider at their ends connected to the support 24,124 than their free ends. In such event, mixing performance at a high level may still be obtained, especially when considering that in some respects such a variation may improve certain functions, and decrease others.

In an embodiment where vanes 126 extend from both sides of the support 124, the support 124 may comprise a top portion and a bottom portion which may be selectively connected and disconnected. In such event, if a user wishes to mix material in a shallow container, the user may remove the bottom portion of the mixing device 120 and simply use the top portion having vanes extending only upwardly therefrom. It will be appreciated that the embodiment device 20 described above may be similarly configured to be "divisible" into two portions for use in shallow containers as well. In the embodiment described, the mixing device 120 is well suited to mixing material in a shallow container. The vanes 126 on the lower or bottom side 140 of the support 124 are positioned in the shallow material. Because of the short vane 126 configuration, the device 120 is capable of creating a mixing vortex, which increases the rate of mixing.

Use of the mixing device 120 of this embodiment of the invention is similar to that of the mixing device 20 described above and illustrated in FIG. 5. In particular, a rotary drive is coupled to the shaft 122 and the device 120 is located in a container containing material to be mixed. The device 120 is then rotated to mix the material.

Preferably, the device 120 is rotated so that the convex surfaces of the vanes 126 face in the direction of rotation. As in the prior embodiment, it is possible for the vanes 126 to be flat or be concave in the direction of rotation.

As with the prior embodiment, mixing with this device 120 is extremely effective. First, mixing is generally accomplished in one or more magnitudes less time than in the prior art. Further, the mixing is uniform and very thorough, with globules of material strained by the device 120 for removal from the material.

Figure 7:
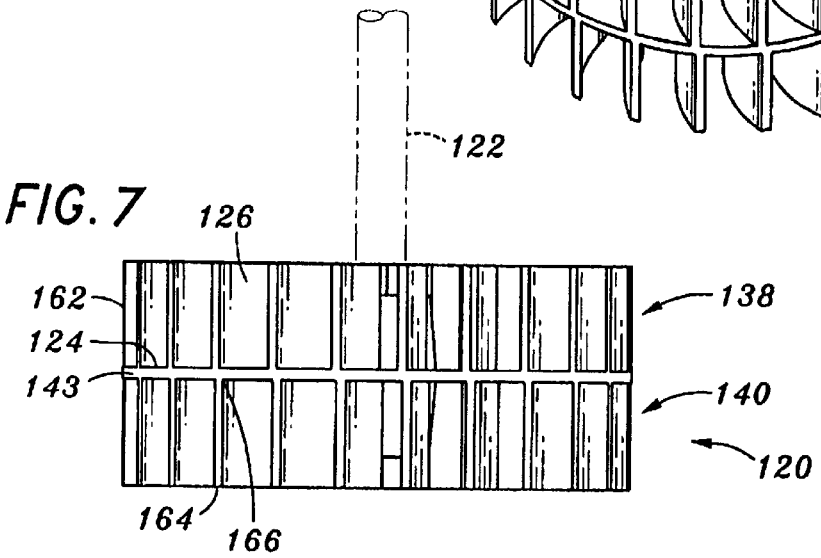
FIG. 7 is a side view of the mixing device illustrated in FIG. 6.

The mixing device 120 illustrated in FIGS. 6–8 and described above has particular applicability in situations where the material to be mixed is extremely viscous, such as in the case of food batter, joint and wall compound (i.e. plaster) and the like, and/or where material level is shallow. As will be appreciated, such materials when first being mixed often are substantially granular or contain particulate solids. For example, wall texture comprises a powder-like material. A fluid, such as water, is added to the material to form the final product. During the initial phase of mixing, before the water is fully integrated into the material, the vanes 126 of the mixing device 120 are useful in moving the material and in breaking up clumps of the material. In particular, the short rigid vanes having a large leading edge impact and cut or shear the clumps of material apart, as the material flows through the device 120 and is mixed thereby. In this regard, the device can be used to mix entirely solid materials, such as to mix small particulate matter, such as in pharmaceuticals, where the solid material(s) display fluid-like characteristics.

It has been found that the mixing device 120 exhibits characteristics similar to those of the mixing device 20 described above. The location of a substantial portion of each vane 126 near the outer edge 143 of the support 124 causes material flowing through the device 120 to impact on the vanes 126 with a high velocity. The material being mixed flows into the device 120 and is then directed outwardly, gaining a high radial velocity. Now moving at high speed, the material then hits the vanes 126 with high force. In addition, since a substantial portion of each vane 126 is positioned near the outer edge 143 of the support 124 and the support 124 has a relatively large size, the outer portion of each vane 126 has a high angular velocity with respect to the material which is passing there through, facilitating shearing of the material.

As described in part above, the vanes 126 need not be located at the outer edge of the support 124 so long as the vanes 126 meet the above-described criteria and are located sufficiently far from the center of the support (or axis of rotation) to achieve the desired shearing effect. For example, it is contemplated that the support 124 may comprise a large disc (or multiple discs) with the outer edge of each vane positioned some distance inwardly from the outer edge of the disc. Such a configuration has the advantage that when the support 124 extends beyond the outer edges of the vanes 126, the support 124 may protect the container and the vanes 126. Those of skill in the art will appreciate that the vanes 126 are still preferably configured as described above to achieve the effects described herein, though in such case the above references of vane dimensions and configurations to the total size of the support and the position at the "outer edge" of the support 126 must be reconstrued to accommodate for the extension of the support beyond the vanes. For example, the distance by which the vanes 126 extend inwardly may be about 0.35 of the distance from the center of the support 124 to the outer edge of the vanes 126 (instead of the outer edge of the support). Likewise, the height ratio of the vanes 126 may be made with reference to the distance between outer edges of opposing or generally opposing vanes 126 (instead of the diameter of the support).

In accordance with the invention, the distance by which the vanes 26,126 extend inwardly is preferably with reference to the axis of rotation of the device. In a preferred embodiment, the axis of rotation is the center of the support 24,124. As stated above, however, the axis of rotation may be other than a center of the support 24,124, such as if the shaft is connected to the support 24,124 in an offset manner. In such event, the inward extension distance is preferably measured to the axis of rotation and not to the center of the support. In such an embodiment or similar embodiments, the maximum inward extension distance may apply to a substantial portion of the vanes 26,126, but not all of the vanes. For example, in an embodiment where the axis of rotation is offset, the axis may be closer to a number of the vanes than the remainder of the vanes. In such event, as long as a substantial portion of the vanes 26,126 meet the criteria, the above-described functions will be performed.

The configuration of the vanes 126 provides for maximum flow through the device 120, when considering the difficulty in moving very viscous fluids or dense or heavy fluids and similar materials. First, the vanes 126 are relatively short and wide, and relatively rigid and serve to chop and shear material through which they are rotated. This serves to homogenize the material being mixed. Also, because the vanes 126 are relatively short and wide, and thus maintain a large surface area, the flow of material through the vanes is maximized. The configuration of the device 120 also makes the device 120 particular suited to use in mixing shallow materials (e.g. such as where the entire device 120 is not submerged in the material to be mixed).

Second, as stated above, the spacing of the vanes 126 at their inner edges 160 serves to trap globules of material. Because of the close spacing of the vanes 126 at their inner edges 160, most all undesirable globules and other material which will not go into solution can be strained from the material being mixed. At the same time, the larger spacing of the vanes 126 at their outer edges 162 permits free flow of the material from the device 120.

As with the prior mixing device 20, when the mixing device 120 of this embodiment of the invention is used, air is not introduced into the material being mixed, so long as the device 120 is properly positioned below the surface of the material being mixed.

It will be understood that the above described arrangements of apparatus and the method therefrom are merely illustrative of applications of the principles of this invention and any other embodiments and modifications may be made without departing from the spirit and scope of the invention as defined in the claims.

We claim:

1. A method of mixing a fluid comprising the steps of:

isolating a fluid to be mixed in a container;

providing a mixing structure having a support having a top side, a bottom side, an outer edge and an axis of rotation passing there through generally perpendicular to said top and bottom side, a number of vanes spaced about the periphery of said support, each vane having a first end connected to said support and a second end positioned remote from said support, said vanes extending from at least one of said sides of said support generally parallel to said axis, said vanes having an outer edge and an inner edge, said outer edge positioned near the periphery of said support, said vanes extending inwardly towards a center of said support to said inner edge, said vanes having a maximum spacing therebetween of less than about 0.45 inches and having a length between said first and second ends thereof in a ratio of vane length to a maximum dimension of said support of no more than about 0.3;

positioning said structure in said container containing fluid; and rotating said structure within said container containing fluid about said axis, whereby said fluid is mixed and undispersable materials are strained by said vanes.

2. The method in accordance with claim 1 including providing said vanes such that a minimum spacing between one or more of said vanes is approximately 0.3 inches or less.

3. The method in accordance with claim 1 wherein said providing step includes arranging said inner edge of one or more of said vanes to not extend inwardly towards said axis of said support by more than about 0.35 of a distance between said axis and said outer edge of said vanes, whereby said fluid reaches a high radial velocity and is sheared as it impacts said vanes.

4. A method of mixing a fluid comprising the steps of:

isolating a fluid to be mixed in a container;

providing a mixing structure having a support having a top side, a bottom side, an outer edge and an axis of rotation passing there through generally perpendicular to said top and bottom side, a number of vanes spaced about the periphery of said support, each vane having a first end connected to said support and a second end positioned remote from said support, said vanes extending from at least one of said sides of said support generally parallel to said axis, said vanes having an outer edge and an inner edge, said outer edge positioned near the periphery of said support, said vanes extending inwardly towards a center of said support to said inner edge no more than about 0.4 of the distance between said outer edge of said vane and said axis, said vanes having a maximum spacing therebetween of less than about 0.45 inches and having a length between said first and second ends thereof in a ratio of vane length to a maximum dimension of said support of no more than about 0.3;

positioning said structure in said container containing fluid; and rotating said structure within said container containing fluid about said axis, whereby said fluid is mixed and undispersable materials are strained by said vanes, said fluid reaches a high radial velocity and is sheared as it impacts said vanes, and said generally short vanes permitting a high fluid flow rate into an interior area of said structure.

* * * * *

UNITED STATES PATENT AND TRADEMARK OFFICE

CERTIFICATE OF CORRECTION

PATENT NO. : 6,325,532 B1
DATED : December 4, 2001
INVENTOR(S) : King et al.

It is certified that error appears in the above-identified patent and that said Letters Patent is hereby corrected as shown below:

Column 3,
Line 17, “further objections” is corrected to read -- further objects --
Line 37, “present invention” is corrected to read -- present invention; --

Column 4,
Line 39, “distal of the entirely” is corrected to read -- distal of the entirety --

Column 5,
Line 56, “resent invention” is corrected to read -- present invention --

Column 6,
Line 2, “at speed dependent” is corrected to read -- at a speed dependent --

Column 12,
Line 24, “flat or be concave” is corrected to read -- flat or to be concave --
Line 27, “magnituides less” is corrected to read -- magnitudes less in --

Column 13,
Line 48, “particular suited” is corrected to read -- particularly suited --

Signed and Sealed this

Twentieth Day of August, 2002

*Attest:*

*Attesting Officer*

JAMES E. ROGAN
*Director of the United States Patent and Trademark Office*